US005946834A

United States Patent [19]

Bradley

[11] Patent Number: 5,946,834

[45] **Date of Patent: *Sep. 7, 1999**

[54] MULTIPLE PANEL GATE FOLDED ADHERED GREETING CARD AND METHOD OF AUTOMATED MANUFACTURE

[75] Inventor: Sterling E. Lani Bradley, N. Olmsted, Ohio

[73] Assignee: American Greetings Corporation, Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,311

[22] Filed: Sep. 22, 1995

[51] Int. Cl.[6] ..... G09F 1/00

[52] U.S. Cl. ..... 40/124.16; 40/124.09; 40/124.14; 248/174; 248/459

[58] Field of Search ..... 40/124.08, 124.09, 40/124.13, 124.14, 124.15, 124.16, 124.191, 539, FOR 100; 248/174, 459

[56] References Cited

U.S. PATENT DOCUMENTS

| | | | |
|---|---|---|---|
| 735,486 | 8/1903 | Fels | 40/124.16 X |
| 1,311,733 | 7/1919 | Wilmot . | |
| 1,524,338 | 1/1925 | Chesney | 248/459 X |
| 1,694,551 | 12/1928 | Meller | 40/539 X |
| 2,035,021 | 3/1936 | Pyle et al. | 248/459 X |
| 2,464,879 | 3/1949 | Mathewson | 40/124.09 |
| 2,473,352 | 6/1949 | Zimmerman . | |
| 2,600,429 | 6/1952 | Ranseen | 40/124.15 X |
| 2,824,394 | 2/1958 | Lohnes . | |
| 2,845,733 | 8/1958 | Fox | 248/459 X |
| 3,305,206 | 2/1967 | Nichols | 248/459 |
| 3,547,342 | 12/1970 | Smith . | |
| 3,713,673 | 1/1973 | Katz . | |
| 4,613,157 | 9/1986 | Drabish . | |
| 4,711,046 | 12/1987 | Herrgord | 40/124.191 X |
| 4,826,211 | 5/1989 | Sinnott et al. . | |
| 4,991,812 | 2/1991 | MacEwan | 248/459 |
| 5,076,611 | 12/1991 | Bouton . | |
| 5,117,569 | 6/1992 | Bean . | |
| 5,813,596 | 9/1998 | Dahlquist | 229/92.8 |

FOREIGN PATENT DOCUMENTS

| | | | |
|---|---|---|---|
| 609448 | 9/1948 | United Kingdom | 40/100 |

*Primary Examiner*—Brian K. Green
*Assistant Examiner*—Andrea Chop
*Attorney, Agent, or Firm*—Calfee, Halter & Griswold LLP

[57] ABSTRACT

A multiple panel foldable greeting card and method of making has abutting surfaces of adjacent panels in a folded configuration adhered together in at least two different areas so that a fold line or fold lines which connect the panels can be partially or entirely eliminated in a secondary die cutting operation without detaching the panels, and the card can be folded out into a three dimensional configuration. The edges of the panels and cut-outs may be chamfered by use of a chamfered cutting die and blade in primary or secondary cutting operations.

10 Claims, 3 Drawing Sheets

MULTIPLE PANEL GATE FOLDED ADHERED GREETING CARD AND METHOD OF AUTOMATED MANUFACTURE

FIELD OF THE INVENTION

The present invention pertains generally to greeting cards and methods of making and, in particular, to multiple panel foldable greeting cards producible in mass quantities.

BACKGROUND OF THE INVENTION

Foldable greeting cards which have multiple panels are desirable for the large amount of message and graphic display area provided. Multiple card panels connected by fold lines are typically produced by first printing upon card stock, cutting individual cards, and then forming fold lines between the panels. In mass production, this approach limits the possible peripheral configurations of the panels for the reason that panels with intricately cut edges are not easily conveyed through paper handling machinery. Also, formation of multiple fold lines by automated card stock folding machines is hindered by non-linear edges on the panels. Cutting of peripheral edges of the panels after folding is problematic in that portions of fold lines are eliminated along panel edges coincident with fold lines. The complexity of such cards has heretofore required manual construction and assembly, substantially increasing production costs. Furthermore, the prior art has not provided multiple panel cards wherein adjoining panels are secured together to form a three dimensional card which can also be peripherally die cut without eliminating panel adjoining fold lines.

SUMMARY OF THE INVENTION

The present invention provides a multiple panel three dimensional greeting card and method of manufacture wherein card stock is printed on both sides, die cut, folded along lines which define adjoining panels, and abutting surfaces of adjacent panels are adhered together. The adhesive securement of adjacent panels allows the card in the folded configuration to be die cut a second time about the entire periphery of the card without detaching any of the panels, even when a fold line is cut off entirely. The card may then be opened into a three dimensional configuration.

In accordance with one aspect of the invention, abutting surfaces of adjacent panels may be adhered together to form a three dimensional stand for vertical display of a connected front panel.

In accordance with another aspect of the invention, at least one of the panels of the multiple panel greeting card of the present invention may be individually cut in the initial cutting of the card stock to form one or more subpanels foldable out from the plane of the panel.

In accordance with another aspect of the invention, perforations may be formed along peripheral edges of adjacent panels near a connecting fold line to allow the fold line to be removed from the card by tearing along the perforations, whereupon the card may opened into a three dimensional configuration.

In accordance with still another aspect of the invention, the die cutting of the panels of the card may be performed with chamfered edge forming dies and templates whereby peripheral and/or internal cut-out edges of the panels are chamfered to enhance the appearance and strength of the panels.

These and other aspects of the invention will be apparent upon reading the following detailed description made with reference to the accompanying Figures.

DETAILED DESCRIPTION OF PREFERRED EMBODIMENTS

Figure 1:
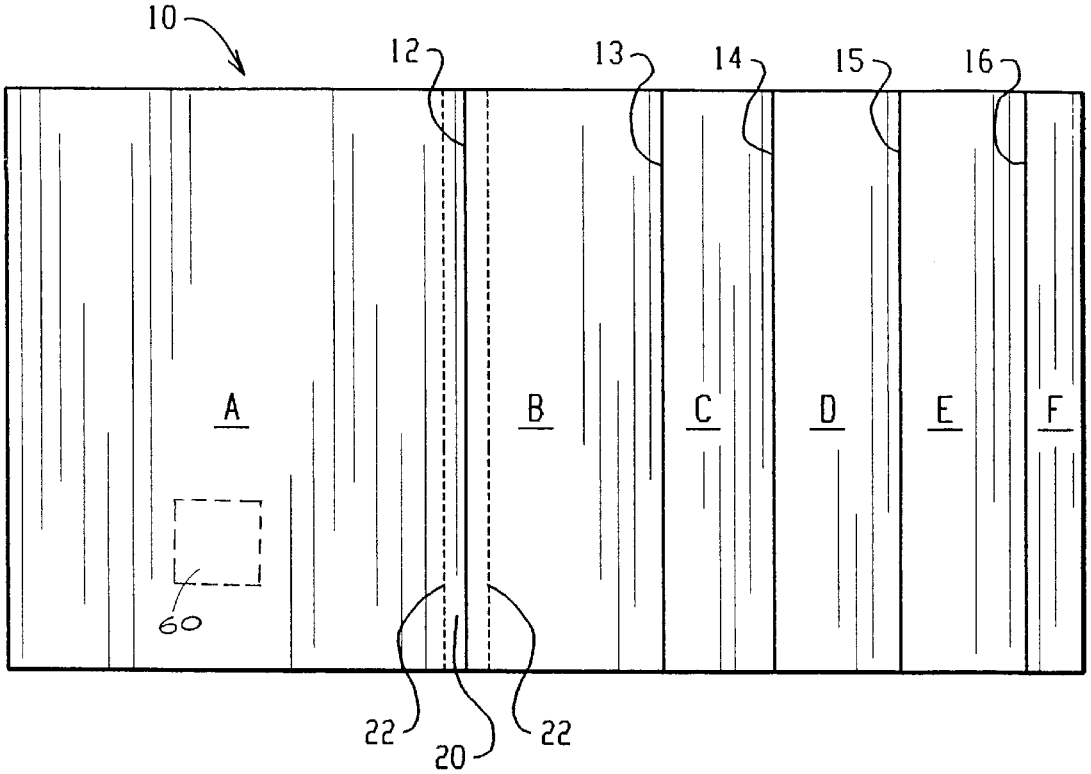
FIG. 1 is a plan view of an embodiment of the card of the present invention in an unfolded configuration.
Figure 2:
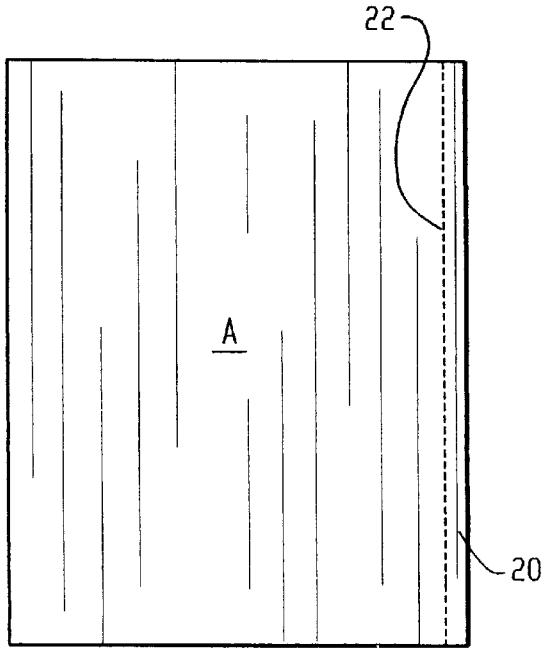
FIG. 2 is a front view of the card of FIG. 1 in a folded configuration.
Figure 3:
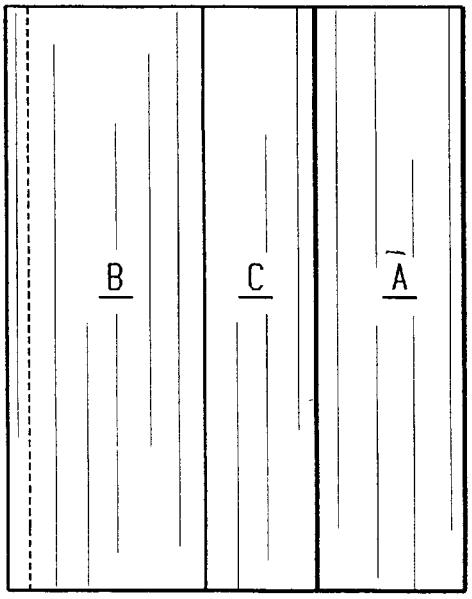
FIG. 3 is a rear view of the card of FIG. 1 in a folded configuration.

FIGS. 1–5 illustrate one embodiment of a multiple panel foldable three dimensional greeting card 10 of the present invention which includes a front panel A, intermediate panels B, C, D, E, and an end panel F adjoined along respective fold lines 12–16. In this embodiment panel A has the greatest width, intermediate panels B–E of relatively less width, and end panel F of relatively small width. With respect to the card structure and method of automated manufacture, FIG. 1 illustrates the card 10 in an unfolded configuration in which it is automatically die cut and printed upon one or both sides of each of the panels by automated die cutting and printing machinery as well known in the art. Fold lines 12–16 are thereafter formed by automated folding machinery in connection with automated application of glue or other adhesive to selected areas of, for example, panels A and/or D and/or F and/or B. The card is thereby automatically folded and adhered into the gate-folded configuration shown from the front in FIG. 2 and the rear in FIG. 3.

Figure 4:
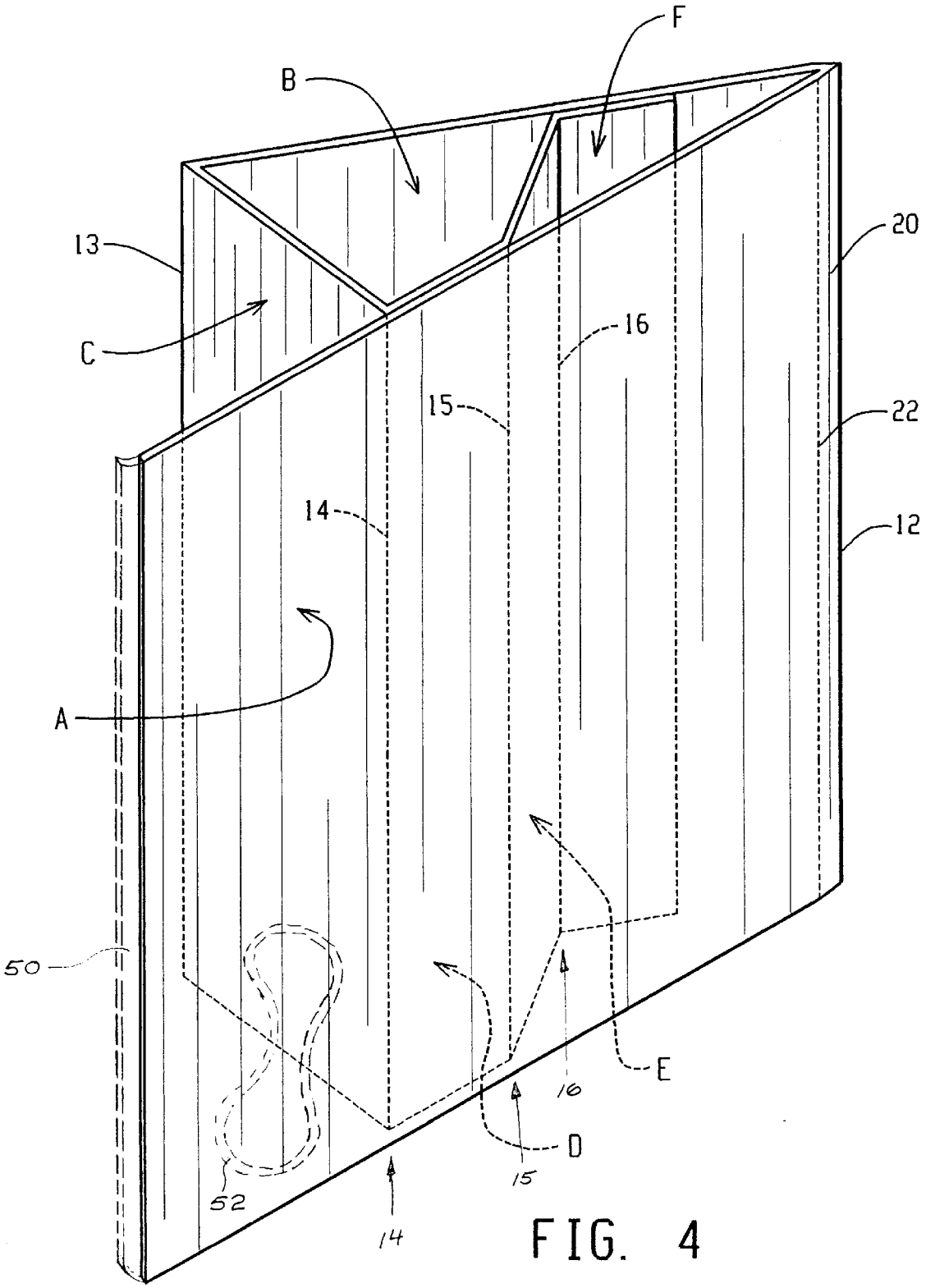
FIG. 4 is a perspective view of the card of FIG. 1 in a partially folded configuration.

FIG. 4 illustrates a perspective of the card 10 in a partially unfolded configuration with edge portion 20, connecting panels A and B, not yet removed. Abutting surfaces of panel D against panel A, and panel F against panel B are adhered together by (automated) application of suitable adhesive to form an integral three dimensional structure wherein panel A is adhered to a stand formed by panels B–F as described below. Once panels D and F are automatically adhered to panels A and B respectively, fold line 12 is no longer necessary to interconnect the panels and may therefore be entirely eliminated or lopped off (for example to the extent of shaded edge portion 20) in a secondary automated die cutting operation performed on the card when in the folded configuration of FIGS. 2 and 3. By this secondary cutting operation, the peripheral edges of panels A and B may be formed in any desired profile. Edge portion 20 of adjoining panels A and B may alternatively be formed to be removable along coincident frangible perforated lines 22 in panels A and B, such as a removable cardboard strip. Alternatively, fold line 12 may be perforated. As shown from above in FIG. 5, following removal of edge portion 20, panels B–F are foldable outward away from the rear of panel A to serve as a three dimensional stand to vertically support panel A.

Figure 5:
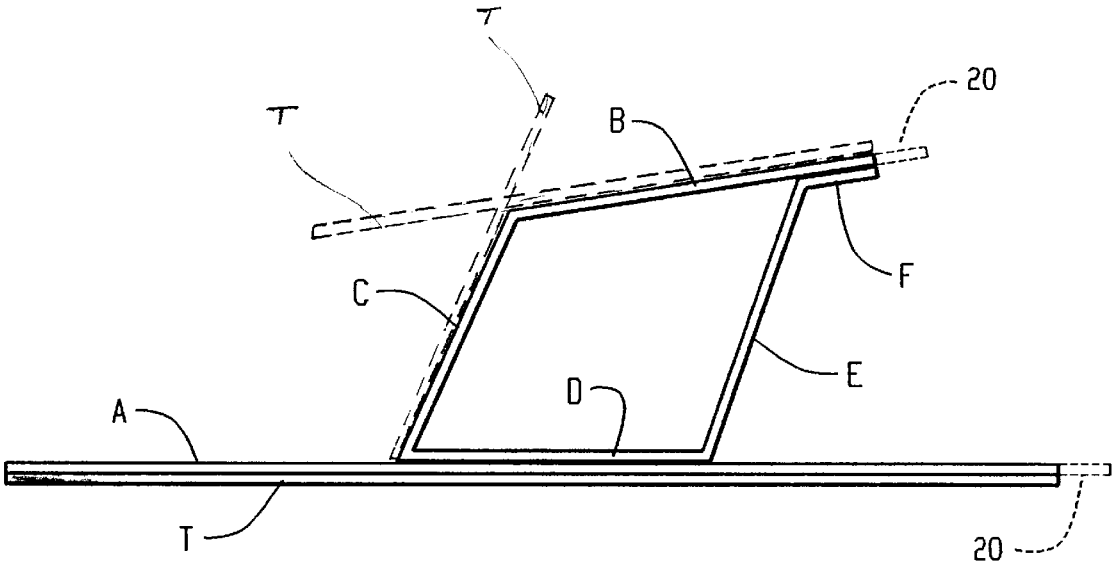
FIG. 5 is a top view of the card of FIG. 1 in an unfolded three dimensional configuration.

As further shown in FIG. 5, an additional panel T may be adhesively secured or "tipped on" to panels A and/or B or C and vertically supported by panels A, B or C and the described stand. The ability to add panel(s) T as a tip-on to the three dimensional card structure further increases the flexibility of the card designs executable in accordance with the invention, for example, panel T is produced in a separate automated operation and subsequently applied to the card in a folded or unfolded configuration. Furthermore, panel T can be peripherally die cut in a secondary cutting operation after attachment to panels A, B or C.

Figure 6:
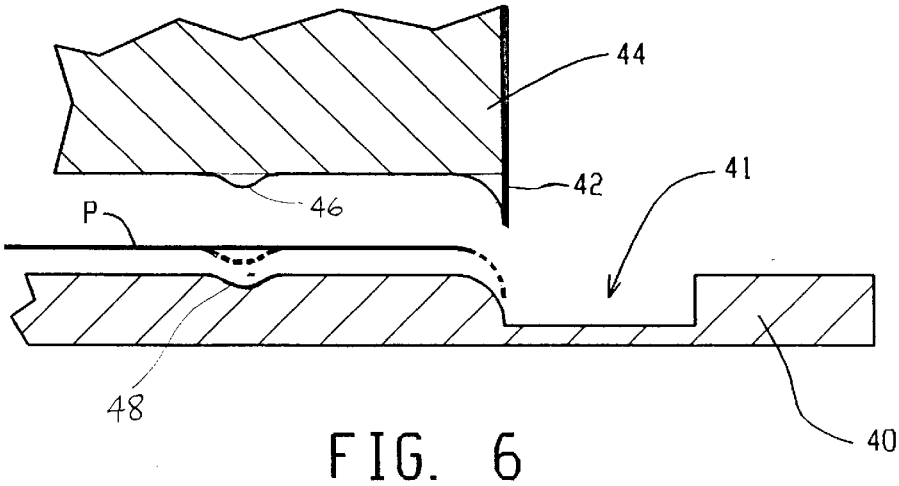
FIG. 6 is a cross section of an edge portion of a panel forming die and template of the present invention.

In accordance with another aspect of the invention which is applicable to and performed simultaneously with any of the described automated die cutting operations in forming the panels of the card, the die cutting apparatus (including blade-receiving cutting dies and correspondingly configured die cutting blades) may be configured to be tapered along the cutting edge for the peripheral edges or internal cut-out edges of a panel to form chamfered edges to any particular peripheral or internal cut-out edges of a card panel. Accordingly, as used herein, the term "edges" refers to peripheral edges of any panels of a card and to edges of internal cut-outs or holes (such as cut-out 60 shown in phantom in FIG. 1) in the area of any panels of a card. FIG. 6 illustrates one example of a card forming die 44 and a corresponding card forming template 40 which has a chamfered edge forming well 41 for receiving a correspondingly tapered cutting blade 42 of cutting die 44 which, by pressure upon the card panel P placed therebetween, chamfers an edge of card stock material immediately adjacent the peripheral edge defined by the die cut. Panel edges (of the periphery and/or internal cut-outs) chamfered in this manner have improved appearance and increased structural stiffness, particularly along the edges. The die cut formed chamfered edge provides additional design and structural detail to the card without requiring additional manufacturing steps.

In combination with the chamfered edge forming die cutting apparatus and method of the invention, FIG. 6 further illustrates an embossing/debossing protrusion 46 of die 44 with a corresponding well 48 in template 40 whereby an area of card panel P is embossed or debossed relative to a front face or plane of the panel. As used herein, "embossed" refers to a depression in a frontal plane of a greeting card panel, and "debossed" refers to a raised area of a frontal plane of a greeting card panel. Protrusion 46 may be in the form of scoring rule attached to die 44. The pattern of such embossing or debossing, as determined by protrusion 46, may or may not correspond to printed material on the card panel. The unobvious combination of protrusion 46 with chamfered cutting blade 42 of die 44 enables chamfered edge cutting and decorative embossing/debossing to be performed in a single production step. FIG. 4 illustrates in phantom a chamfered edge 50 and emboss/deboss 52 formed on the front panel of the card by the apparatus and method of the invention.

The present invention thus novelly provides a multiple panel/multi-dimensional greeting card and method of making wherein each of the panels can receive printing on both sides, the edges of each of the panels may be uniquely formed by die cutting, abutting panels may be glued together, and fold lines adjoining adhered panels may be eliminated in secondary die cutting operations to allow the card to be unfolded and expanded into a multi-dimensional configuration.

I claim:

1. A multiple panel three dimensional greeting card comprising:

six generally rectangular adjacent panels each having two oppositely disposed lateral edges, the panels comprising a front panel, four intermediate panels, and an end panel, the panels being interconnected at the lateral edges along parallel fold lines, the front panel having one of the lateral edges being a free edge, and the other opposite lateral edge being connected along a fold line to one lateral edge of a first intermediate panel;

an end panel connected along a fold line to one lateral edge of a fourth intermediate panel;

second and third intermediate panels being located between the first and fourth intermediate panels, a surface of the end panel attached to a surface of the first intermediate panel, and a surface of tle third intermediate panel attached to a surface of the front panel.

2. The multiple panel three dimensional greeting card of claim 1 wherein the first intermediate panel is not immediately adjacent to the end panel.

3. The multiple panel three dimensional greeting card of claim 1 wherein the fold line between the front panel and the first intermediate panel is eliminated after the surfaces of the third and first intermediate panels are attached to the surfaces of the front and end panels respectively, whereby the intermediate panels and end panel can be located away from the plane of the front panel.

4. The multiple panel three dimensional greeting card of claim 1 wherein portions of peripheral edges of at least two panels and at least one fold line are cut by a die cutting operation.

5. The multiple panel three dimensional greeting card of claim 1 further comprising at least one additional panel attached to the front panel.

6. A multiple panel greeting card comprising:

a piece of card stock die cut so that peripheral edges of the card stock define peripheral edges of panels of the greeting card;

the die cut piece of card stock folded to have at least six adjacent panels each having two oppositely disposed lateral edges, said panels being interconnected at the lateral edges by substantially parallel fold lines, the six panels including a front panel, four intermediate panels, and an end panel, the front panel having one of the lateral edges being a free edge and the other opposite lateral edge being connected to a first intermediate panel, and the end panel being connected to a fourth intermediate panel, a surface of the first intermediate panel attached to a surface of the end panel, and a surface of another intermediate panel attached to a surface of the front panel, and at least one other intermediate panel between the end panel and the another intermediate panel attached to the surface of the front panel, and a further intermediate panel between the first intermediate panel and the another intermediate panel attached to the surface of the front panel.

7. The multiple panel greeting card of claim 6 wherein the fold line between the front panel and the first intermediate panel is eliminated after the surface of the end panel is attached to the surface of the first intermediate panel.

8. The multiple panel greeting card of claim 6 wherein any one of the fold lines interconnecting the panels is at least partially eliminated in a cutting operation.

9. A multiple panel three dimensional gate folded greeting card comprising:

a) a front panel (A) connected along one edge to a first intermediate panel (B) by a first fold line;

b) the first intermediate panel (B) connected along another fold line parallel to said first fold line to a second intermediate panel (C);

c) the second intermediate panel (C) connected along another fold line parallel to said first fold line to a third intermediate panel (D);

d) the third intermediate panel (D) connected along another fold line parallel to said first fold line to a fourth intermediate panel (E), e) the fourth intermediate panel (E) connected along another fold line parallel to said first fold line to an end panel (F), f) a surface of the end panel (F) attached to a surface of the first intermediate panel (B), and g) a surface of the third intermediate panel (D) attached to a surface of the front panel (A).

10. The greeting card of claim 9 wherein the fold line between the front panel (A) and the first intermediate panel (B) is at least partially eliminated after the surface of the end panel (F) is attached to the surface of the first intermediate panel (B), whereby the greeting card can be placed in a three dimensional configuration.

* * * * *